United States Patent [19]

Nakashima et al.

[11] Patent Number: 5,066,343

[45] **Date of Patent: * Nov. 19, 1991**

[54] PROCESS FOR PREPARATION OF THIN GRAIN ORIENTED ELECTRICAL STEEL SHEET HAVING SUPERIOR IRON LOSS AND HIGH FLUX DENSITY

[75] Inventors: Shozaburo Nakashima; Kenzo Iwayama; Isao Iwanaga, all of Kitakyushu, Japan

[73] Assignee: Nippon Steel Corporation, Tokyo, Japan

[ * ] Notice: The portion of the term of this patent subsequent to Aug. 14, 2007 has been disclaimed.

[21] Appl. No.: 520,109

[22] Filed: May 7, 1990

[30] Foreign Application Priority Data

May 13, 1989 [JP] Japan ..... 1-119145

[51] Int. Cl.[5] ..... H01F 1/04

[52] U.S. Cl. ..... 148/111; 148/112; 164/476; 164/477

[58] Field of Search ..... 148/111, 112; 164/476, 164/477

[56] References Cited

U.S. PATENT DOCUMENTS 4,948,433 8/1990 Nakashima et al. ..... 148/111

FOREIGN PATENT DOCUMENTS 0333221 9/1989 European Pat. Off. ..... 148/111
57-41326 3/1982 Japan .
58-217630 12/1983 Japan .
60-59044 4/1985 Japan .
61-79721 4/1986 Japan .
61-117215 6/1986 Japan .

*Primary Examiner*—John P. Sheehan
*Attorney, Agent, or Firm*—Kenyon & Kenyon

[57] ABSTRACT

Disclosed is a process for preparing a thin grain oriented electrical steel sheet having a final thickness of 0.05 to 0.25 mm from a silicon steel cast strip having a thickness of 0.2 to 5 mm and directly obtained from the molten steel by the synchronous continuous casting machine, in which the speed of movement of the strand relative to the inner wall surface of the casting mold is the same, and by which the traditional hot rolling process can be omitted, comprising 0.050 to 0.120% by weight of C, 2.8 to 4.0% by weight of Si and 0.05 to 0.25% by weight of Sn, wherein the starting silicon cast strip further comprises up to 0.035% by weight of S and 0.005 to 0.035% by weight of Se, with the proviso that the total amount of S and Se is in the range of 0.015 to 0.060% by weight, 0.050 to 0.090% by weight of Mn, with the proviso that the Mn content is in the range of {1.5×[content (% by weight) of S+content (% by weight) of Se]} to {4.5×[content (% by weight) of S+content (% by weight) of Se]} % by weight, 0.0050 to 0.0100% by weight of N, and {[27/14]×content (% by weight) of N+0.0030} to {[27/14]×content (% by weight) of N+0.0150} % by weight of acid-soluble Al.

2 Claims, 6 Drawing Sheets

| MARK | ○ | △ | × |
|---|---|---|---|
| $W_{15/50}$ (W/kg) | BELOW 0.55 | 0.56 ~0.60 | ABOVE 0.61 |

IRON LOSS OF Cu-ADDED MATERIAL — IRON LOSS OF Cu-FREE MATERIAL $\Delta W_{15/50}$ (W/kg)

IRON LOSS OF Sb-ADDED MATERIAL— IRON LOSS OF Sb-FREE MATERIAL $\Delta W_{15/50}$ (W/kg)

PROCESS FOR PREPARATION OF THIN GRAIN ORIENTED ELECTRICAL STEEL SHEET HAVING SUPERIOR IRON LOSS AND HIGH FLUX DENSITY

BACKGROUND OF THE INVENTION (1) Field of the Invention

The present invention relates to a process for the preparation of a grain oriented electrical steel sheet to be used for an iron core of an electric appliance. More particularly, the present invention relates to a process for the preparation of a thin steel sheet having improved iron loss characteristics.

(2) Description of the Related Art

A grain oriented electrical steel sheet is mainly used as a magnetic core material of a transformer or other electric appliance, and this grain oriented electrical material must have superior magnetic characteristics such as exciting characteristics and iron loss characteristics.

To obtain a steel sheet having superior magnetic characteristics, the <001> axis, which is the easy magnetization axis, must be highly oriented in the rolling direction. Furthermore, the magnetic characteristics are greatly influenced by the sheet thickness, the crystal grain size, the inherent resistance, and the surface film.

The orientation of an electrical steel sheet is greatly improved by the heavy reduction one-stage cold rolling process in which AlN or MnS is caused to function as an inhibitor, and currently, an electrical steel sheet having a flux density corresponding to about 96% of the theoretical value is used.

To cope with increasing energy costs, makers of transformers have an urgent need for magnetic materials having a reduced iron loss, as materials for energy-saving transformers.

High-Si materials such as amorphous alloys and 6.5% Si alloys have been developed as materials having a low iron loss, but the price and processability of these materials as the material for a transformer are unsatisfactory.

The iron loss of an electrical steel sheet is greatly influenced by not only the Si content but also the sheet thickness, and it is known that, if the thickness of the sheet is reduced by chemical polishing, the iron loss is reduced.

As the conventional process for preparing a thin grain oriented electrical steel sheet having a high flux density, the techniques disclosed in Japanese Unexamined Patent Publication No. 57-41326, Japanese Unexamined Patent Publication No. 58-217630, Japanese Unexamined Patent Publication No. 60-59044, Japanese Unexamined Patent Publication No. 61-79721, and Japanese Unexamined Patent Publication No. 61-117215, are known.

Japanese Unexamined Patent Publication No. 57-41326 discloses a preparation process in which a material comprising, as the inhibitor, 0.010 to 0.035% of at least one member selected from S and Se and 0.010 to 0.080% of at least one member selected from Sb, As, Bi and Sn is used as the starting material.

Japanese Unexamined Patent Publication No. 58-217630 discloses a preparation process in which a material comprising 0.02 to 0.12% of C, 2.5 to 4.0% of Si, 0.03 to 0.15% of Mn, 0.01 to 0.05% of S, 0.01 to 0.05% of Al, 0.004 to 0.012% of N and 0.03 to 0.3% of Sn or a material further comprising 0.02 to 0.3% or Cu is used as the starting material.

Japanese Unexamined Patent Publication No. 60-59044 discloses a preparation process in which a silicon steel material comprising 0.02 to 0.10% of C, 2.5 to 4.5% of Si, 0.04 to 0.4% of Sn, 0.015 to 0.040% of acid-soluble Al, 0.0040 to 0.0100% of N, 0.030 to 0.150% of Mn and 0.015 to 0.040% of S as indispensable components, and further comprising up to 0.04% of Se and up to 0.4% of at least one member selected from Sb, Cu, As, and Bi is used as the starting material.

Japanese Unexamined Patent Publication No. 61-79721 discloses a preparation process in which a silicon steel material comprising 3.1 to 4.5% of Si, 0.003 to 0.1% of Mo, 0.005 to 0.06% of acid-soluble Al and 0.005 to 0.1% of at least one member selected from S and Se is used as the starting material.

Japanese Unexamined Patent Publication No. 61-117215 discloses a preparation process in which a silicon steel material comprising 0.03 to 0.10% of C, 2.5 to 4.0% of Si, 0.02 to 0.2% of Mn, 0.01 to 0.04% of S, 0.015 to 0.040% of acid-soluble Al and 0.0040 to 0.0100% of N and further comprising up to 0.04% of Se and up to 0.4% of at least one member selected from Sn, Sb, As, Bi, Cu and Cr is used as the starting material.

All of the above prior art processes are based on the assumption that a hot rolling step is accompanied by heating a slab at a high temperature to control an inhibitor.

SUMMARY OF THE INVENTION

In a grain oriented electrical steel sheet, if a magnetic domain subdivisional treatment is carried out by irradiation with laser beams, etc., a thickness of a final product is thinner and a magnetic flax density is higher, and therefore, a greater effect of a low iron loss is obtained.

A grain oriented electrical steel sheet is prepared by utilizing an inhibitor such as AlN or MnS and manifesting a secondary recrystallization at the finish annealing step, but as the thickness of the product is reduced, it becomes difficult to stably manifest an ideal secondary recrystallization.

The transformer makers' needs to reduce the iron loss and lower the manufacturing costs are increasing. Namely, a product having a lower iron loss must be manufactured more stably and at a lower cost, and the above-mentioned conventional techniques do not satisfy these requirements.

A primary object of the present invention is to surpass the conventional techniques and provide a process in which an ideal secondary recrystallization is stably manifested even if the thickness of the product is thin.

Another object of the present invention is to provide a thin product having a much reduced iron loss, at a low cost by carrying out a process which casts directly from molten steel a steel strip having a thickness ob 0.2 to 5 mm, by a synchronous continuous casting machine, e.g., a twin-drum castor, in which the speed of movement of the cast strip (strand) relative to the inner wall surface of a casting mold is the same, and by an omission of an indispensable traditional hot rolling process.

In accordance with the present invention, these objects can be attained by a process for the preparation of a thin grain oriented electrical steel sheet having a reduced iron loss and a high flux density, which comprises subjecting a silicon steel cast strip having a thickness of 0.2 to 5 mm and obtained directly from the molten steel by a synchronous continuous casting machine, e.g., twin-drum castor, in which the speed of movement of the strand relative to the inner wall surface of the casting mold is the same, and by which the traditional hot rolling process can be omitted and comprising 0.050 to 0.120% by weight of C, 2.8 to 4.0% by weight of Si, and 0.05 to 0.25% by weight of Sn, annealing the cast steel strip at a temperature of at least 920° C. for at least 30 seconds before final cold rolling, rolling the annealed steel at a reduction ratio of 81 to 95% at final cold rolling to obtain a final thickness of 0.05 to 0.25 mm, subjecting the steel strip to decarburization annealing, coating an anneal separating agent on the steel strip and subjecting the steel strip to finish annealing; wherein the starting silicon steel cast strip further comprises up to 0.035% by weight of S and 0.005 to 0.035% by weight of Se, with the proviso that the total amount of S and Se is in the range of 0.015 to 0.060% by weight, 0.050 to 0.090% by weight of Mn, with the proviso that the Mn content is in the range of {1.5×[content (% by weight) of S+content (% by weight) of Se]} to {4.5×[content (% by weight) of S+content (% by weight) of Se]} % by weight, 0.0050 to 0.0100% by weight of N, and {[27/14]×content (% by weight of N+0.0030} to {[27/14]×content (% by weight) of N+0.0150} % by weight of acid-soluble Al, with the balance comprising Fe and unavoidable impurities, or wherein the starting cast silicon steel strip further comprises up to 0.035% by weight of S and 0.005 to 0.035% by weight of Se, with the proviso that the total amount of S and Se is in the range of 0.015 to 0.060% by weight, 0.050 to 0.090% by weight of Mn, with the proviso that the Mn content is in the range of {1.5×[content (% by weight) of S+content (% by weight) of Se]} to {4.5×[content (% by weight) of S+content (% by weight) of Se]} % by weight, 0.0050 to 0.0100% by weight of N, and {[27/14]×content (% by weight) of N+0.0030} to {[27/14]×content (% by weight) of N+0.0150} % by weight of acid-soluble Al, and at least one member selected from Cu in an amount of 0.03 to 0.30% by weight and Sb in an amount of 0.005 to 0.035% by weight of Sb, with the balance comprising Fe and unavoidable impurities.

DESCRIPTION OF THE PREFERRED EMBODIMENTS

Figure 1:
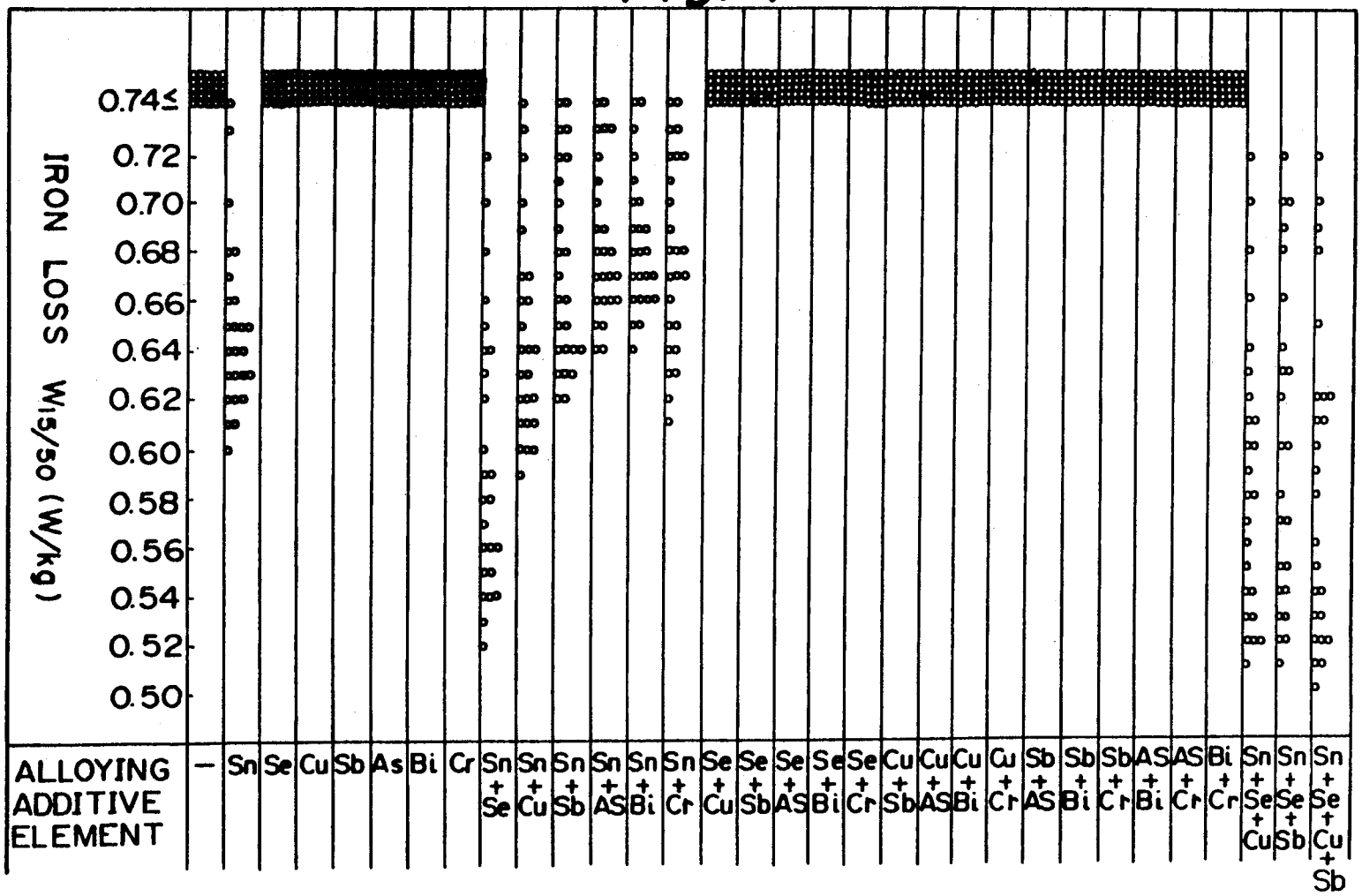
FIG. 1 illustrates the relationship between the alloying element added to the starting material (abscissa) and the iron loss value of the product (ordinate) in a thin grain oriented electrical steel sheet comprising AlN as the main inhibitor.

The structural requirements characterizing the present invention will now be described.

First the present inventors thoroughly examined the influences of alloying additive elements in the production of a thin grain oriented electrical steel sheet characterized by the use of AlN as the main inhibitor and a final cold rolling under a heavy reduction.

Experiment I

Many silicon steel cast strip having a thickness of 1.4 mm and directly obtained from the molten steel by the synchronous continuous casting machine, in which the speed of movement of the strand relative to the inner wall surface of the casting mold is the same, and by which the traditional hot rolling process can be omitted, comprising 0.080% by weight of C, 3.20% by weight of Si, 0.020 to 0.120% by weight Mn, 0.0100 to 0.0450% by weight of acid-soluble Al and 0.0020 to 0.0120% by weight of N, with the balance being substantially Fe, and many silicon steel cast strips having a thickness of 1.4 mm and directly obtained from the molten steel by the synchronous continuous casting machine, in which the speed of movement of the strand relative to the inner wall surface of the casting mold is the same, and by which the traditional hot rolling process can be omitted, comprising 0.080% by weight of C, 3.20% by weight of Si, 0.020 to 0.120% by weight of Mn, 0.025% by weight of S, 0.0100 to 0.0450% by weight of acid-soluble Al, 0.0020 to 0.0120% by weight of N and at least one member selected from Sn in an amount of 0.13% by weight, Se in an amount of 0.010% by weight, Cu in an amount of 0.07% by weight, Sb in an amount of 0.020% by weight, As in an amount of 0.050% by weight, Bi in an amount of 0.10% by weight and Cr in an amount of 0.10% by weight, with the balance being substantially Fe, were heated to 1120° C. and maintained at this temperature for 80 seconds, and steel cast strips were then cooled to room temperature at an average cooling speed of 35° C./sec.

The steel cast strips were cold-rolled to a final thickness of 0.145 mm with five intermediate aging treatments, each conducted at 250° C. for 5 minutes.

Then the rolled steel strips were heated to 840° C. in an atmosphere comprising 75% of $H_2$ and 25% of $N_2$ and having a dew point of 64° C., maintained at this temperature for 120 seconds, and then cooled and coated with an anneal separating agent composed mainly of magnesia. The steel strips were then formed into coils and heated to 1200° C. at a temperature-elevating rate of 20° C./hr in an atmosphere comprising 85% of $H_2$ and 15% of $N_2$, then soaked at 1200° C. for 20 hours in an $H_2$ atmosphere and cooled, and the anneal separating agent was removed and tension coating was carried out to obtain products.

The iron loss values of the products were measured, and the results are shown in FIG. 1. As apparent from the results shown in FIG. 1, relatively good iron loss values were obtained when the slabs contained Sn and when both Sn and Se were contained, especially good iron loss values were obtained.

It is known from Japanese Unexamined Patent Publication No. 58-217630 that, in the production of a thin grain oriented electrical steel sheet characterized by using AlN as the main inhibitor and a final cold rolling under a heavy reduction, where the starting steel contains Sn or Sn and Cu, a grain oriented electrical steel sheet having an excellent iron loss characteristic and a high flux density is obtained. The novel knowledge obtained by Experiment I is that a further improved iron loss value is obtained by a combined addition of Sn and Se. Furthermore, as shown by the results of Experiment I, an improvement of the iron loss characteristic is not attained by an addition of As, Bi, and Cr.

Note, as shown in FIG. 1, even in the case of a combined addition of Sn and Se, the dispersion of the iron loss value is still large and a further improvement is desired.

The influence of the contents of S, Se, Mn, N, and acid-soluble Al were examined, with a view to reducing the dispersion of the iron loss value in products prepared from the starting materials in which a combination of Sn and Se was incorporated.

Experiment II

Many silicon steel cast strip having a thickness of 1.4 mm and directly obtained from the molten steel by the synchronous continuous casting machine, in which the speed of movement of the strand relative to the inner wall surface of the casting mold is the same, and by which the traditional hot rolling process can be omitted, comprising 0.075% by weight of C, 3.20% by weight of Si, 0.070% by weight of Mn, up to 0.050% by weight of S, up to 0.050% by weight of Se, 0.0240% by weight of acid-soluble Al, 0.0085% by weight of N and 0.13% by weight Sn, with the balance being substantially Fe, were treated in the same manner as described in Experiment I to obtain products, and the iron loss values were measured.

Figure 2:
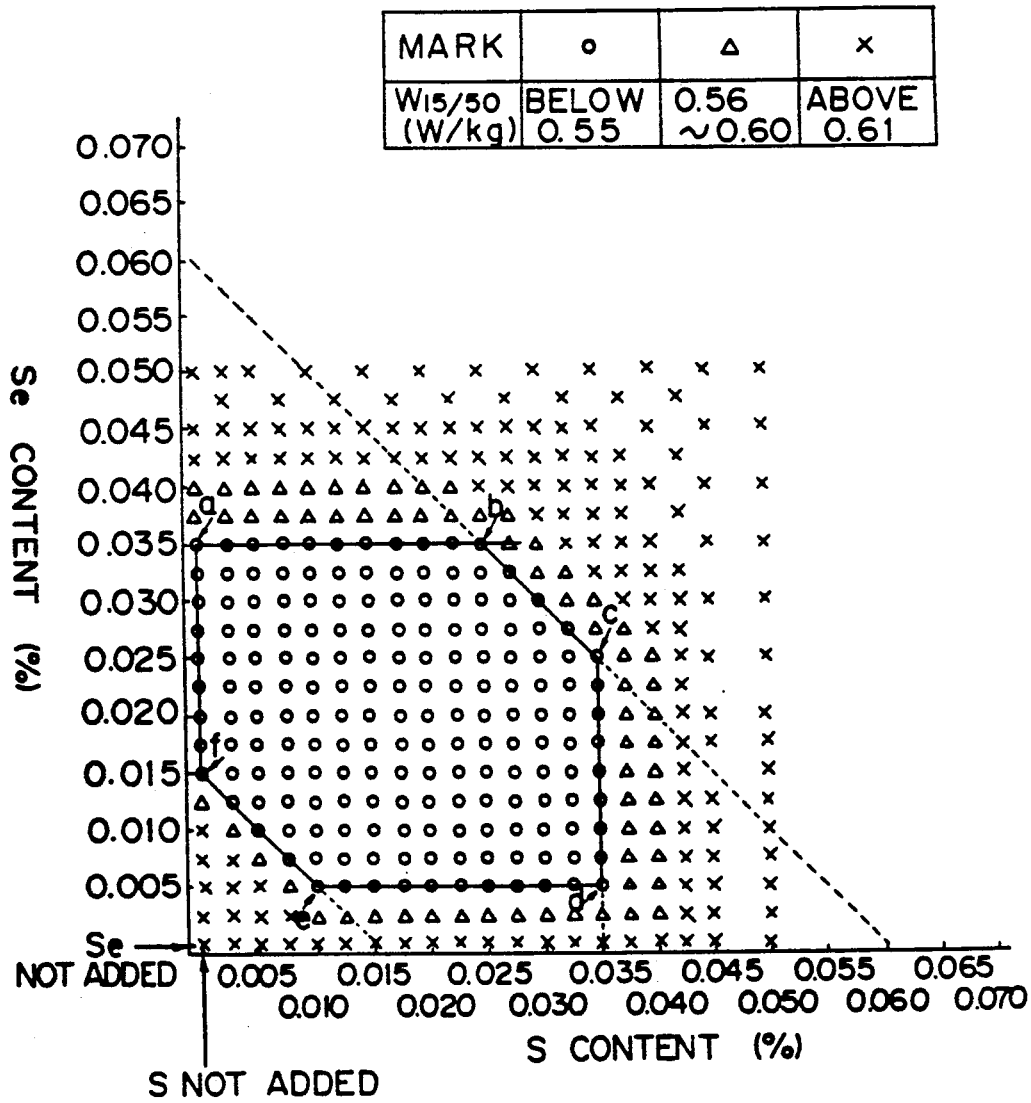
FIG. 2 illustrates the relationship among the S content of the slab (abscissa), the Se content of the slab (ordinate), and the iron loss of the product (indicated by ○, Δ, or x)

The relationship between the iron loss value and the composition of the cast strip is shown in FIG. 2.

In FIG. 2 the S content is plotted on the abscissa and the Se content is plotted on the ordinate. Excellent (low) iron loss values were obtained in the region surrounded by lines ab, bc, cd, de, ef and fa in FIG. 2, and in this region, each of the flux density values B8 was at least 1.90T. The lines bc and ef are expressed by the following formulae:

Line bc: S content (% by weight)+Se content (% by weight)=0.060% by weight

Line ef: S content (% by weight)+Se content (% by weight)=0.015% by weight

From the foregoing results, it was found that a superior (low) iron loss value is stably obtained if the S content is up to 0.035% by weight, the Se content is 0.005 to 0.035% by weight, and the total amount of S and Se is 0.015 to 0.060% by weight.

Experiment III

Figure 3:
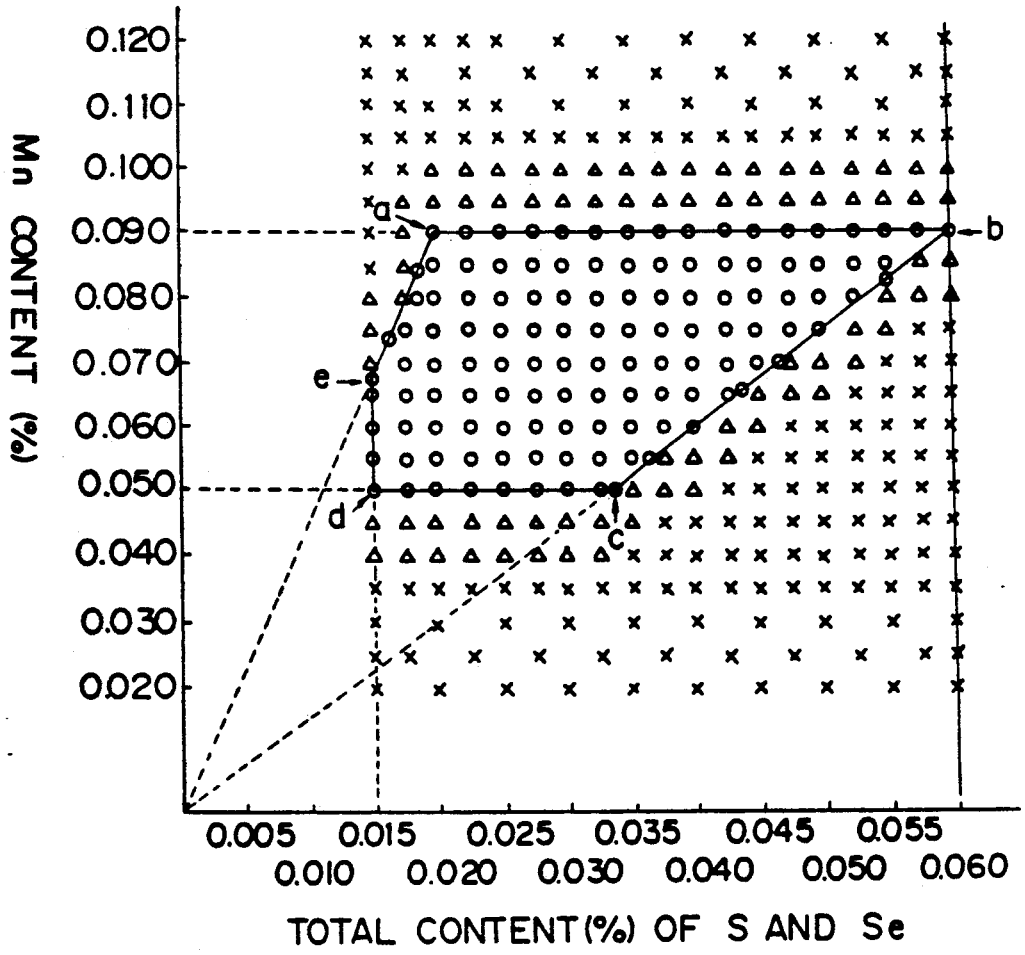
FIG. 3 illustrates the relationship among the total amount of S and Se in the slab (abscissa), the Mn content (ordinate) in the slab, and the iron loss of the product (indicated by ○, Δ, or x)

Many silicon steel cast strips having a thickness 1.4 mm and directly obtained from the molten steel by the synchronous continuous casting machine, in which the speed of movement of the strand relative to the inner wall surface of the casting mold is the same, and by which the traditional hot rolling process can be omitted, comprising 0.075% by weight of C, 3.20% by weight of Si, 0.020 to 0.120% by weight of Mn, up to 0.035% by weight of S, 0.005 to 0.035% by weight of Se, the total amount of S and Se being 0.015 to 0.060% by weight, 0.0240% by weight acid-soluble Al, 0.0085% by weight of N and 0.13% by weight of Sn, with the balance being substantially Fe, were treated in the same manner as described in Experiment I to obtain products, and the iron loss values of the products were measured. The relationship between the iron loss value and the composition of the slab is shown in FIG. 3. In FIG. 3, the total amount of S and Se is plotted on the abscissa and the Mn content is plotted on the ordinate.

Superior (low) values were obtained in the region surrounded by lines ab, bc, cd, de and ea in FIG. 3, and in this region, each of the flux density B8 values was at least 1.90T.

The lines bc and ea are expressed by the following formulae:

Line bc: Mn content (% by weight)=1.5×[total content (% by weight) of S and Se]

Line ea: Mn content (% by weight)=4.5×(total content (% by weight) of S and Se]

From the foregoing results, it was found that a superior (low) value is stably obtained if the total amount of S and Se is 0.015 to 0.060% by weight and the Mn content is 0.050 to 0.090% by weight and in the range of from {1.5×[total content (% by weight) of S and Se]} to (4.5×[total amount (% by weight) of S and Se]} % by weight.

Experiment IV

Many silicon steel cast strips, having a thickness 1.4 mm and directly obtained from the molten steel by the synchronous continuous casting machine, in which the speed of movement of the strand relative to the inner wall surface of the casting mold is the same, and by which the traditional hot rolling process can be omitted, comprising 0.075% by weight of C, 3.20% by weight of Si, 0.070% by weight of Mn, 0.015% by weight of S, 0.015% by weight of Se, 0.0100 to 0.0450% by weight of acid-soluble Al, 0.0020 to 0.0120% by weight of N and 0.13% by weight of Sn, with the balance being substantially Fe, were treated in the same manner as described in Experiment I to obtain products, and the iron loss values were measured.

Figure 4:
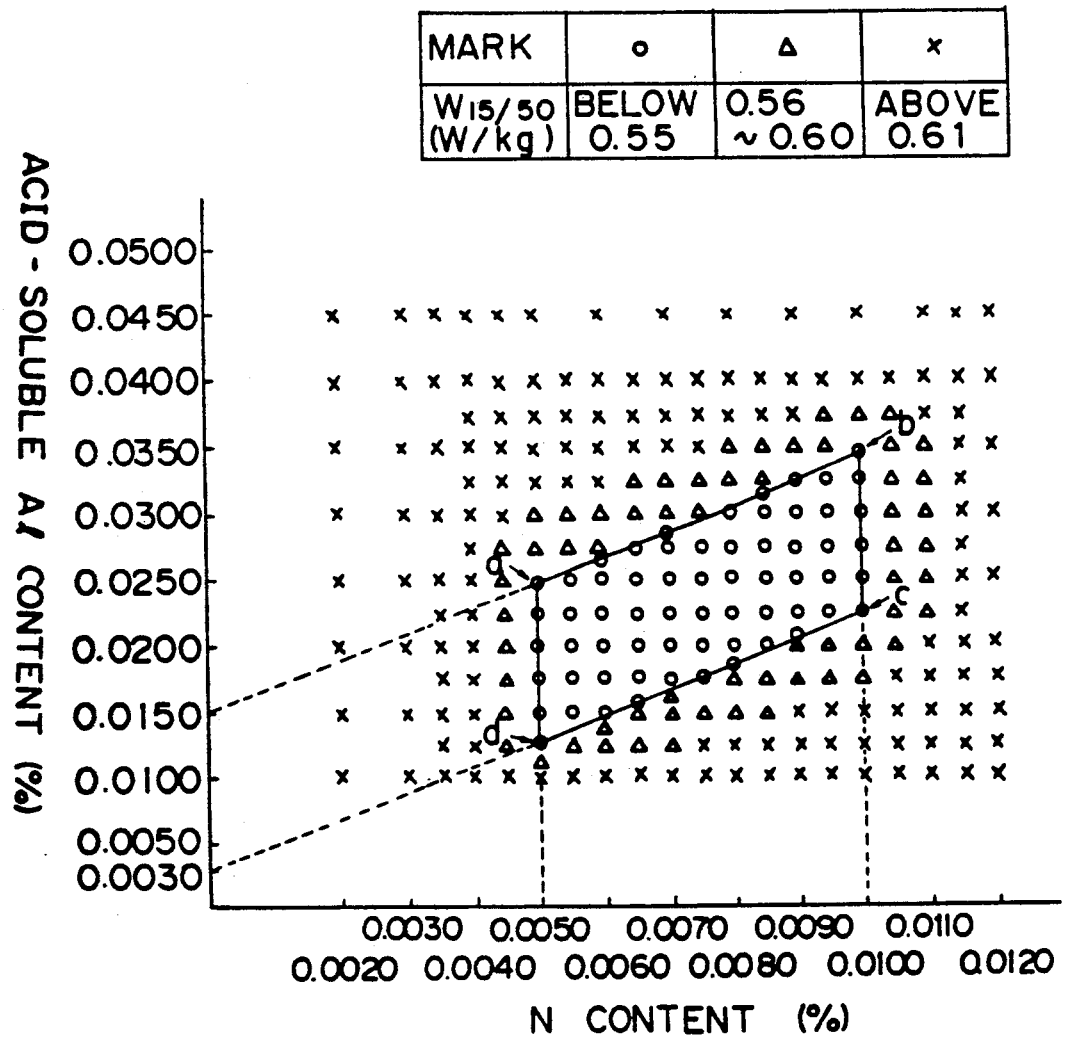
FIG. 4 illustrates the relationship among the N content in the slab (abscissa), the content of acid-soluble Al in the slab (ordinate), and the iron loss of the product (indicated by ○, Δ or x)

The relationship between the iron loss value and the composition of the cast strip is shown in FIG. 4. In FIG. 4, the N content is plotted on the abscissa and the content of acid-soluble Al is plotted on the ordinate.

Superior (low) iron loss values were obtained in the region surrounded by lines ab, bc, cd and da in FIG. 4, and each of the flux density B8 values in this region was at least 1.90T. The lines ab and cd are expressed by the following formulae:

Line ab: acid-soluble Al content (% by weight) ={[27/14]×N content (% by weight) +0.0150} (% by weight)

Line cd: acid-soluble content (% by weight) ={[27/14]×N content (% by weight) +0.0030} (% by weight)

From the foregoing results, it was found that a superior iron loss value is obtained if the N content is 0.0050 to 0.0100% by weight and acid-soluble Al content is {[27/14]×N content (% by weight)+0.0030} to {[27/14×N content (% by weight)+0.0150} % by weight.

Note that [27/14]×N content (% by weight) corresponds to the Al content necessary for all N contained in the steel to be converted to AlN. In the present process, in which AlN is utilized as the main inhibitor, the phenomenon of secondary recrystallization on which the iron loss value depends is influenced by the acid-soluble Al content defined basically by [27/14]×N content (% by weight).

From the results obtained in Experiments II, III and IV, it was found that, to stably obtain a product having a superior (low) iron loss value in the production of a thin grain oriented electrical steel sheet from a silicon steel cast strip having a thickness of 0.2 to 5 mm and directly obtained from the molten steel by the synchronous continuous casting machine, in which the speed of movement of the strand relative to the inner wall surface of the casting mold is the same, and by which the traditional hot rolling process can be omitted, and comprising predetermined amounts of C, Si and Sn, in addition to the predetermined amounts of C, Si and Sn as the components of the starting material, a specific content relationship between S and Se, a specific content relationship among S, Se and Mn, and a specific content relationship between N and acid-soluble Al must be established in combination.

Namely, it was found that, when the starting material comprises predetermined amounts of C, Si and Sn and up to 0.035% by weight of S and 0.005 to 0.035% by weight of Se, with the proviso that the total amount of S and Se is in the range of 0.015 to 0.060% by weight, 0.050 to 0.090% by weight of Mn, with the proviso that the Mn content is in the range of {1.5×[total content (% by weight) of S and Se]} to {4.5×[total content (% by weight) of S and Se]} % by weight, 0.0050 to 0.0100% by weight of N and {[27/14]×N content (% by weight)+0.0030} to {[27/14]×N content (% by weight)+0.0150} % by weight of acid-soluble Al, a thin grain oriented electrical steel sheet having a superior (low) iron loss and a high flux density can be stably prepared, and thus the present invention was completed.

From the results obtained in Experiment I, it was found that if one or both of Cu and Sb are added to a material in which Sn and Se are incorporated in combination, the iron loss characteristic of the product is further improved. The same experiments as the above-mentioned Experiments II, III and IV were conducted on materials of this type, and similar results were obtained, and thus it was confirmed that the present invention also can be effectively applied to Cu- and Sb-added steels.

Many silicon steel cast strips having a thickness 1.4 mm and directly obtained from the molten steel by the synchronous continuous casting machine, in which the speed of movement of the strand relative to the inner wall surface of the casting mold is the same, and by which the traditional hot rolling process can be omitted, comprising 0.075% by weight of C, 3.25% by weight Si, 0.070% by weight of Mn, 0.015% by weight of S, 0.015% by weight of Se, 0.0255% by weight of acid-soluble Al, 0.0085% by weight of N, 0.15% by weight of Sn, and not addition and 0.01 to 0.50% by weight of Cu were treated in the same manner as described in Experiment I to obtain products.

Figure 5:
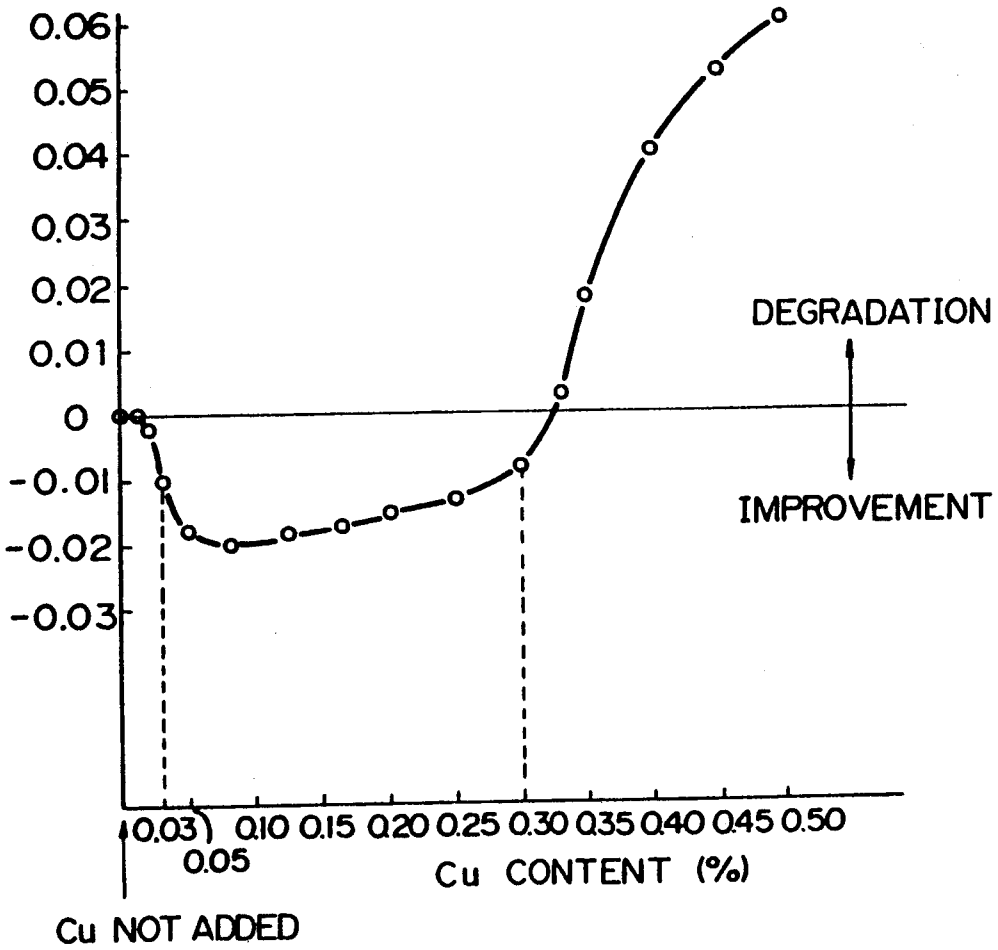
FIG. 5 illustrates the relationship between the Cu content in the slab (abscissa) and the quantity of the change of the iron loss of the product by an addition of Cu (ordinate); and, FIG. 6 illustrates the relationship between the Sb content of the slab (abscissa) and the quantity of the change of the iron loss of the product by an addition of Sb (ordinate).

The relationship between the Cu content and the iron loss is shown in FIG. 5. As is seen from FIG. 5, the iron loss was low (good) if the Cu content was in the range of 0.03 to 0.30% by weight.

Many silicon steel cast strips having a thickness of 1.4 mm and obtained rapid cooling and coagulation comprising 0.078% by weight of C, 3.20% by weight of Si, 0.076% by weight of Mn, 0.018% by weight of S, 0.016% by weight of Se, 0.0255% by weight of acid-soluble Al, 0.0080% by weight of N, 0.13% by weight of Sn, and not addition and 0.001 to 0.050% by weight of Sb were treated in the same manner as described in Experiment I to obtain products.

Figure 6:
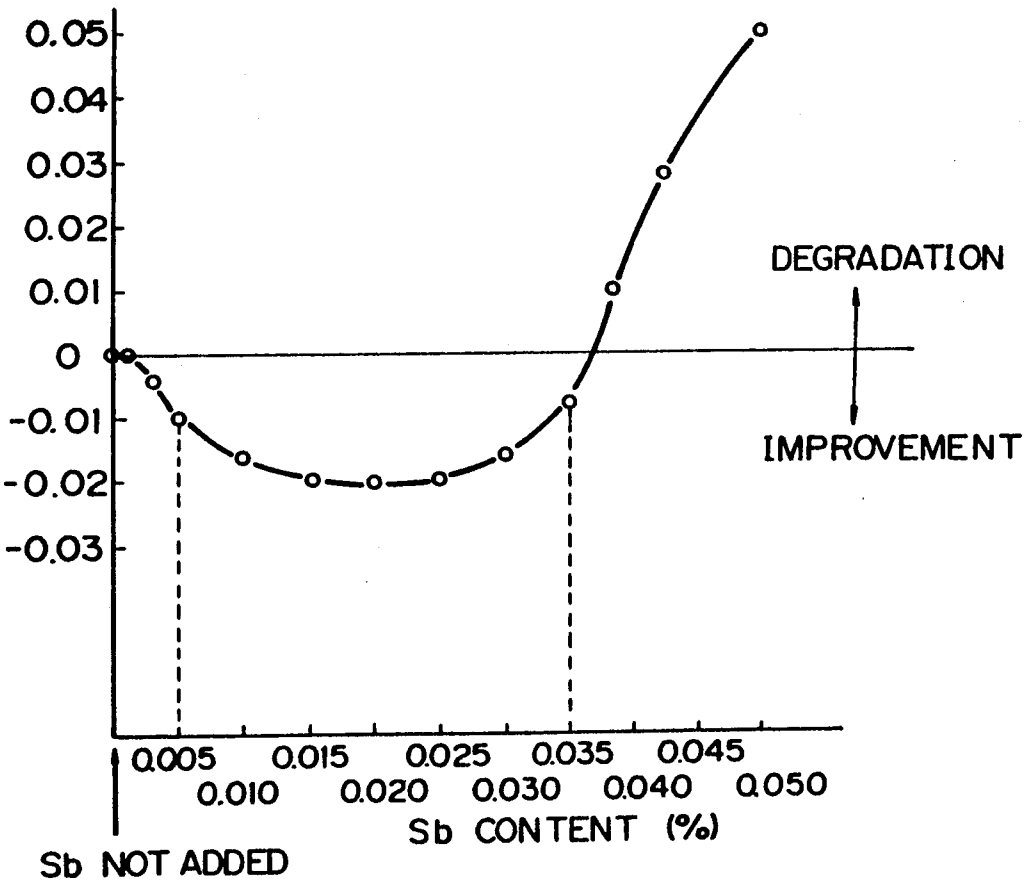

The relationship between the Sb content and the iron loss is illustrated in FIG. 6. As apparent from FIG. 6, the iron loss was low (good) if the Sb content was in the range of 0.005 to 0.035% by weight.

The limitations of other components and preparation conditions will now be described.

Preferably, the C content is 0.050 to 0.120% by weight. If the carbon content is lower than 0.050% by weight or higher than 0.120% by weight the secondary recrystallization becomes unstable at the finish annealing step.

Preferably, the Si content is 2.8 to 4.0% by weight. If the Si content is lower than 2.8% by weight, a good (low) iron loss cannot be obtained, and if the Si content is higher than 4.0% by weight, the processability (adaptability to cold rolling) is degraded.

Preferably, the Sn content is 0.05 to 0.25% by weight. The secondary recrystallization is poor if the Sn content is lower than 0.05%, and the processability is degraded if the Sn content is higher than 0.25% by weight.

The cast strip is directly prepared by rapid cooling and coagulation from a melt by a synchronous continuous casting process in which the relative speed of the cast strip to the inner wall surface of a casting mold is the same. In the continuous casting process of the present invention, a twin-drum method is preferably used to obtain a cast strip having a thickness of 0.2 to 5 mm. If the thickness is smaller than 0.2 mm or exceeds 5 mm, good magnetic characteristics can not be obtained.

With regard to the preparation conditions, if annealing is not conducted at a temperature of at least 920° C. for at least 30 seconds before final cold rolling, a good (low) iron loss cannot be obtained.

If the reduction ratio at final cold rolling is lower than 81%, a good (low) iron loss cannot be obtained, and if this reduction ratio is higher than 95%, the secondary recrystallization becomes unstable.

If the final sheet thickness is smaller than 0.05 mm, the secondary recrystallization becomes unstable, and if the final sheet thickness exceeds 0.25 mm, a good (low) iron loss cannot be obtained.

The present invention will now be described in detail with reference to the following examples.

EXAMPLE 1

Many silicon cast strips, having a thickness of 1 5 mm and directly obtained from the molten steel by the synchronous continuous casting machine, in which the speed of movement of the strand relative to the inner wall surface of the casting molt is the same, and by which the traditional hot rolling process can be omitted, comprising 0.082% by weight of C, 3.25% by weight of Si, 0.13% by weight of Sn, 0.003 to 0.037% by weight of S, 0.002 to 0.040% by weight of Se, 0.040 to 0.110% by weight of Mn, 0.0040 to 0.0108% by weight of N, 0.0180 to 0.0350% by weight of acid-soluble Al, not addition or 0.02 to 0.50% by weight of Cu, and not addition or 0.020 to 0.060% by weight of Sb, with the balance being substantially Fe, were heated to 1120° C. and maintained at this temperature for 100 seconds, and then were immersed in water maintained at 100° C. for cooling. The materials were then cold-rolled to a final thickness of 0.170 mm with five intermediate aging treatments, each conducted at 250° C. for 5 minutes.

The rolled strips were then heated to 850° C. in an atmosphere comprising 75% of $H_2$ and 25% of $N_2$ and having a dew point of 66° C., were maintained at this temperature for 120 seconds, and were then cooled. An anneal separating agent composed mainly of magnesia was coated on the materials, and the materials were formed into coils. The coils were heated to 1200° C. at a temperature-elevating rate of 25° C./hr in an atmosphere comprising 85% of $H_2$ and 15% of $N_2$, soaked at 1200° C. for 20 hours in an $H_2$ atmosphere, and then cooled. The anneal separating agent was removed and tension coating was carried out to obtain products.

The iron loss value (W 15/50) and the flux density (B8) of each product were measured, and the results are shown in Table 1. As seen from Table 1, a superior (low) iron loss value was obtained only when the contents of S and Se, the total amount of S and Se, and the contents of Mn, N and acid-soluble Al were within the ranges specified in the present invention.

Furthermore, when the contents of Cu and Sb were within the ranges specified in the present invention, the characteristics were further improved.

TABLE 1

| Run No. | Composition of Silicon Steel Cast Strip: S $\times 10^{-3}$ % | Se $\times 10^{-3}$ % | S + Se $\times 10^{-3}$ % | Mn $\times 10^{-3}$ % | 1.5 × (S + Se) $\times 10^{-3}$ % | 4.5 × (S + Se) $\times 10^{-3}$ % | N $\times 10^{-4}$ % | acid-soluble Al $\times 10^{-4}$ % |
|---|---|---|---|---|---|---|---|---|
| 1 | 14 | 16 | 30 | 70 | 45 | 135 | 85 | 250 |
| 2 | x37 | 6 | 43 | 70 | 65 | 194 | 83 | 250 |
| 3 | 25 | x2 | 27 | 70 | 41 | 122 | 85 | 255 |
| 4 | 3 | x40 | 43 | 70 | 65 | 194 | 80 | 240 |
| 5 | 7 | 6 | x13 | 55 | 20 | 59 | 83 | 250 |
| 6 | 30 | 35 | x65 | 85 | x98 | 293 | 84 | 242 |
| 7 | 12 | 12 | 24 | x40 | 36 | 108 | 80 | 240 |
| 8 | 15 | 20 | 35 | x110 | 53 | 158 | 82 | 230 |
| 9 | 10 | 6 | 16 | 85 | 24 | x72 | 80 | 245 |
| 10 | 22 | 18 | 40 | 55 | x60 | 180 | 85 | 245 |
| 11 | 15 | 15 | 30 | 80 | 45 | 135 | x40 | 190 |
| 12 | 16 | 16 | 32 | 75 | 48 | 144 | x108 | 280 |
| 13 | 15 | 20 | 35 | 80 | 53 | 158 | 80 | 350 |
| 14 | 20 | 14 | 34 | 78 | 51 | 153 | 82 | 180 |
| 15 | 15 | 17 | 32 | 65 | 48 | 144 | 70 | 256 |
| 16 | 15 | 17 | 32 | 65 | 48 | 144 | 70 | 256 |
| 17 | 15 | 17 | 32 | 65 | 48 | 144 | 70 | 256 |
| 18 | 15 | 17 | 32 | 65 | 48 | 144 | 70 | 256 |
| 19 | 16 | 14 | 30 | 70 | 45 | 135 | 80 | 265 |
| 20 | 16 | 14 | 30 | 70 | 45 | 135 | 80 | 265 |
| 21 | 16 | 14 | 30 | 70 | 45 | 135 | 80 | 265 |
| 22 | 16 | 14 | 30 | 70 | 45 | 135 | 80 | 265 |

| Run No. | Composition of Silicon Steel Cast Strip: $\frac{27}{14} \times N$ (%) +0.0030 (%) $\times 10^{-4}$ % | $\frac{27}{14} \times N$ (%) +0.0150 (%) $\times 10^{-4}$ % | Cu $\times 10^{-2}$ % | Sb $\times 10^{-3}$ % | Magnetic Characteristics of product: $W_{15/50}$ W/kg | $B_8$ T | Remarks |
|---|---|---|---|---|---|---|---|
| 1 | 194 | 314 | — | — | 0.55 | 1.94 | present invention |
| 2 | 190 | 310 | — | — | 0.61 | 1.90 | comparison |
| 3 | 194 | 314 | — | — | 0.63 | 1.89 | " |
| 4 | 184 | 304 | — | — | 0.62 | 1.89 | " |
| 5 | 190 | 310 | — | — | 0.61 | 1.90 | " |
| 6 | 192 | 312 | — | — | 0.63 | 1.87 | " |
| 7 | 184 | 304 | — | — | 0.62 | 1.89 | " |
| 8 | 188 | 308 | — | — | 0.68 | 1.83 | " |
| 9 | 184 | 304 | — | — | 0.63 | 1.88 | " |
| 10 | 194 | 314 | — | — | 0.60 | 1.91 | " |
| 11 | 107 | 227 | — | — | 0.67 | 1.83 | " |
| 12 | 238 | 358 | — | — | 0.63 | 1.87 | " |
| 13 | 184 | x304 | — | — | 0.62 | 1.89 | " |
| 14 | x188 | 308 | — | — | 0.60 | 1.90 | " |
| 15 | 165 | 285 | — | — | 0.55 | 1.94 | present invention |
| 16 | 165 | 285 | 2 | — | 0.55 | 1.94 | present invention |
| 17 | 165 | 285 | 7 | — | 0.53 | 1.95 | present invention |
| 18 | 165 | 285 | x50 | — | 0.61 | 1.90 | comparison |
| 19 | 184 | 304 | — | — | 0.55 | 1.94 | present invention |
| 20 | 184 | 304 | — | 20 | 0.53 | 1.95 | present invention |
| 21 | 184 | 304 | — | x60 | 0.61 | 1.91 | comparison |
| 22 | 184 | 304 | 7 | 20 | 0.52 | 1.96 | present invention |

Note
x value outside the scope of the present invention.

EXAMPLE 2

Silicon steel cast strips having a thickness of 2.0 mm and directly obtained from the molten steel by the synchronous continuous casting machine, in which the speed of movement of the strand relative to the inner wall surface of the casting molt is the same, and by which the traditional hot rolling process can be omitted, A, B, C and D shown in Table 2 were heated to 1120° C. and maintained at this temperature for 120 seconds, and then immersed in water maintained at 100° C. for cooling. Parts of the materials were cold-rolled to a thickness of 1.2 mm, heated to 1000° C., maintained at this temperature for 60 seconds, and cooled by immersion in water maintained at 100° C. These materials were cold-rolled to a final thickness of 0.145 mm (from 1.2 mm) or 0.250 mm (from 2.0 mm) with five intermediate aging treatments, each conducted at 250° C. for 5 minutes.

The materials were then heated to 850° C. in an atmosphere comprising 75% of $H_2$ and 25% of $N_2$ and having a dew point of 66° C., and maintained at this temperature for 120 seconds. The materials were then cooled and an anneal separating agent composed mainly of magnesia was coated on the materials, and the materials were formed into coils. The coils were heated to 1200° C. at a temperature-elevating rate of 25° C./hr in an atmosphere comprising 85% of $H_2$ and 15% of $N_2$, soaked at 1200° C. in $H_2$ atmosphere for 20 hours and cooled, and the anneal separating agent was removed and tension coating was carried out to obtain products.

The iron loss value (W 15/50) and flux density (B8) of each of the products were measured, and the results are shown in Table 3. As apparent from Table 3, a superior (low) iron loss value was obtained only when the composition of the starting material was within the scope of the present invention.

EXAMPLE 3

Two silicon steel cast strips having a thickness of 1.8 mm and directly obtained from the molten steel by the synchronous continuous casting machine, in which the speed of movement of the strand relative to the inner wall surface of the casting molt is the same, and by which the traditional hot rolling process can be omitted, comprising 0.075% by weight of S, 0.0020% by weight of SE, 0.0250% by weight of acid-soluble Al, 0.0040 or 0.0085% by weight of N and 0.14% by weight of Sn, with the balance being substantially Fe, were heated to 1100° C., maintained at this temperature for 80 seconds, and cooled by immersion in water maintained at 100° C.

The materials were cold-rolled to a thickness of 0.38 or 0.77 mm, heated to 1000° C. maintained at this temperature for 60 seconds to effect annealing, and then cooled by immersion in water maintained at 100° C.

The materials were cold-rolled to a final thickness of 0.05 mm (from 0.38 mm) or 0.10 mm (from 0.77 mm) with five intermediate aging treatments, each conducted at 250° C. for 5 minutes. The obtained strips were heated to 840° C. in an atmosphere comprising 75% of $H_2$ and 25% of $N_2$ and having a dew point of 64° C. and maintained at this temperature for 90 minutes to effect decarburization annealing. The strips were coated with an anneal separating agent composed mainly of magnesia and wound in coils.

The materials were heated to 1200° C. at a temperature-elevating rate of 25° C./hr in an atmosphere comprising 75% of $H_2$ and 25% of $N_2$ and soaked at 1200° C. for 20 hours in $H_2$ atmosphere to effect finish annealing.

The anneal separating agent was then removed and tension coating was carried out to obtain products.

The iron loss value (W 13/50) and the flux density (B8) of each of the obtained products were measured, and the results are shown in Table 4.

The surfaces of the products were irradiated with laser beams at intervals of 5 mm in the direction orthogonal to the rolling direction, and the iron loss value (W 13/50) of each product was measured, and the results are shown in Table 4.

As apparent from the results shown in Table 4, a superior (low) iron loss characteristic was obtained only when the starting material having a composition within the scope of the present invention was used.

TABLE 2

| Kind of cast-strip | C $\times 10^{-3}$% | Si $\times 10^{-2}$% | Mn $\times 10^{-3}$% | S $\times 10^{-3}$% | Se $\times 10^{-3}$% | acid-soluble Al $\times 10^{-4}$% | N $\times 10^{-4}$% | Cu $\times 10^{-2}$% | Sn $\times 10^{-2}$% | balance |
|---|---|---|---|---|---|---|---|---|---|---|
| A | 78 | 325 | 70 | 25 | — | 255 | 85 | 7 | 13 | substantially Fe |
| B | 78 | 325 | 70 | 15 | 15 | 255 | 85 | 7 | 13 | substantially Fe |
| C | 78 | 325 | 70 | 25 | — | 255 | 85 | 7 | — | substantially Fe |
| D | 78 | 325 | 70 | 15 | 15 | 255 | 85 | 7 | — | substantially Fe |

TABLE 3

| Thickness of Product mm | Kind of Cast-Strip | Magnetic Characteristics of Product $W_{15/50}$ W/kg | $B_8$ T | Remarks |
|---|---|---|---|---|
| 0.145 | A | 0.61 | 1.90 | comparison |
| 0.145 | B | 0.51 | 1.95 | present invention |
| 0.145 | C | 0.91 | 1.62 | comparison |
| 0.145 | D | 0.93 | 1.61 | " |
| 0.250 | A | 0.70 | 1.91 | " |
| 0.250 | B | 0.62 | 1.95 | present invention |
| 0.250 | C | 0.92 | 1.75 | comparison |
| 0.250 | D | 0.95 | 1.72 | " |

TABLE 4

| Run No. | Composition of Cast strip N $\times 10^{-4}$% | Thickness of Product mm | Magnetic Characteristics of Product $W_{13/50}$ W/kg | $B_8$ T | Iron Loss after Irradiation with Laser Beams $W_{13/50}$ W/kg | Remarks |
|---|---|---|---|---|---|---|
| 1 | 40 | 0.05 | 0.65 | 1.60 | not measured | comparison |
| 2 | 85 | 0.05 | 0.35 | 1.93 | 0.25 | present invention |
| 3 | 40 | 0.10 | 0.70 | 1.62 | not measured | comparison |
| 4 | 85 | 0.10 | 0.37 | 1.94 | 0.27 | present invention |

As apparent from the foregoing description, according to the present invention, a grain oriented electrical steel sheet having a low iron loss, especially a thin unidirectional electromagnetic steel sheet in which the effect of reducing the iron loss is increased with the magnetic domain is finely divided by irradiation with laser beams or the like, can be stably prepared, and accordingly, the industrial value of the present invention is very high.

We claim:

1. A process for the preparation of a thin grain oriented electrical steel sheet or strip having a reduced iron loss and a high flux density, which comprises casting a molten silicon steel to form a silicon steel strip having a thickness of 0.2 to 5 mm, by a synchronous continuous casting machine in which the relative movement speed of the cast strip to the inner wall surface of a casting mold is the same, which molten steel comprises 0.050 to 0.120% by weight of C, 2.8 to 4.0% by weight of Si and 0.05 to 2.25% by weight of Sn, annealing the cast steel strip at a temperature of at least 920° C. for at least 30 seconds, rolling the annealed strip at a reduction ratio of 81 to 95% at final cold rolling to obtain a final thickness of 0.05 to 0.25 mm, subjecting the resulting cold rolled steel strip to decarburization annealing, coating the decarburized steel with an anneal separator and subjecting the steel strip to finish annealing, wherein the starting cast strip further comprises up to 0.035% by weight of S and 0.005 to 0.035% by weight of Se, with the proviso that the total amount of S and Se is in the range of 0.015 to 0.060% by weight, 0.050 to 0.090% by weight of Mn, with the proviso that the Mn content is in the range of {1.5×[content (% by weight) of S+content (% by weight) of Se[} to {4.5×[content (% by weight) of S+content (% by weight) of Se]} % by weight, 0.0050 to 0.0100% by weight of N, and {[27/14]×content (% by weight) of N+0.0030} to {[27/14]×content (% by weight) of N+0.0150} % by weight of acid-soluble Al, with the balance comprising Fe and unavoidable impurities.

2. A preparation process according to claim 1, wherein the starting silicon steel cast strip further comprises at least one material selected from a group consisting of Cu in an amount of 0.03 to 0.30% by weight and Sb in an amount of 0.005 to 0.035% by weight.

* * * * *

UNITED STATES PATENT AND TRADEMARK OFFICE

CERTIFICATE OF CORRECTION

PATENT NO. : 5,066,343

DATED : November 19, 1991

INVENTOR(S) : S. NAKASHIMA, et al.

It is certified that error appears in the above-identified patent and that said Letters Patent is hereby corrected as shown below:

Column 2, line 56, change "ob" to --of--.

Column 7, line 45, change "thickness 1.4" to --thickness of 1.4--.

Column 8, line 52, change "molt" to --mold--.

Column 12, line 7, change "molt" to --mold--.

Column 12, line 9, change "of S," to --of C, 3.25% by weight of Si, 0.075% by weight of Mn, 0.015% by weight of S,--.

Column 13, line 31, change "2.25% to --0.25%--.

Column 13, line 33, change "annealed strip" to --annealed steel strip--.

Column 14, line 23, change "Se[" to --Se]--.

Signed and Sealed this

Seventeenth Day of August, 1993

*Attest:*

*Attesting Officer*

BRUCE LEHMAN

*Commissioner of Patents and Trademarks*